US008907650B2

(12) United States Patent
Zhen et al.

(10) Patent No.: US 8,907,650 B2
(45) Date of Patent: Dec. 9, 2014

(54) TEMPERATURE ADAPTIVE BANDGAP REFERENCE CIRCUIT

(75) Inventors: Shaowei Zhen, Chengdu (CN); Ping Luo, Chengdu (CN); Ruhui Yang, Chengdu (CN); Kang Yang, Chengdu (CN); Bo Zhang, Chengdu (CN)

(73) Assignee: University of Electronic Science and Technology of China, Chengdu (CN)

( * ) Notice: Subject to any disclaimer, the term of this patent is extended or adjusted under 35 U.S.C. 154(b) by 0 days.

(21) Appl. No.: 13/637,237

(22) PCT Filed: Feb. 28, 2011

(86) PCT No.: PCT/CN2011/071383

§ 371 (c)(1),
(2), (4) Date: Sep. 25, 2012

(87) PCT Pub. No.: WO2012/109805

PCT Pub. Date: Aug. 23, 2012

(65) Prior Publication Data

US 2013/0314068 A1 Nov. 28, 2013

(30) Foreign Application Priority Data

Feb. 18, 2011 (CN) ..... 2011 1 0040925

(51) Int. Cl.
*G05F 3/16* (2006.01)
*G05F 3/30* (2006.01)

(52) U.S. Cl.
CPC .. *G05F 3/16* (2013.01); *G05F 3/30* (2013.01); *Y10S 323/907* (2013.01)
USPC ..... 323/312; 323/907; 327/340

(58) Field of Classification Search
USPC ..... 323/311–316, 907; 327/538–541
See application file for complete search history.

(56) References Cited

U.S. PATENT DOCUMENTS

| | | | | |
|---|---|---|---|---|
| 5,084,665 | A | 1/1992 | Dixon et al. | |
| 6,297,689 | B1 * | 10/2001 | Merrill | 327/540 |
| 7,164,259 | B1 * | 1/2007 | Megaw et al. | 323/313 |
| 7,372,242 | B2 * | 5/2008 | Xi | 323/313 |
| 7,420,359 | B1 | 9/2008 | Anderson et al. | |
| 2005/0237045 | A1 | 10/2005 | Lee et al. | |

FOREIGN PATENT DOCUMENTS

| | | |
|---|---|---|
| CN | 101105699 | 1/2008 |
| CN | 101180594 | 5/2008 |
| CN | 201435019 | 3/2010 |
| CN | 101881986 | 11/2010 |

* cited by examiner

*Primary Examiner* — Rajnikant Patel
(74) *Attorney, Agent, or Firm* — Caesar, Rivise, Bernstein, Cohen & Pokotilow, Ltd.

(57) ABSTRACT

This invention involves a bandgap reference circuit in IC. The temperature coefficient of conventional bandgap reference is large and the higher order compensation is difficult to implement. This invention provides an adaptive compensated bandgap reference which solves the problem only using lower order (first order) temperature coefficient compensation. The invention adopts segmental compensation circuit to realize adaptive segmental compensation of bandgap reference with low temperature coefficient. The technical solution includes traditional bandgap voltage reference circuit and adaptive feedback compensation circuit which consists of sample and hold circuit, voltage comparator and control module. This invention controls the bandgap voltage reference through systematical view and it has high process compatibility. This invention can find the best temperature characteristic curve adaptively, the output voltage has low temperature coefficient, meeting the requirement of fabrication process, the implementation is simple with small area. This invention relates to integrated circuits.

10 Claims, 2 Drawing Sheets

TEMPERATURE ADAPTIVE BANDGAP REFERENCE CIRCUIT

CROSS-REFERENCE TO RELATED APPLICATIONS

This national stage application claims the benefit under 35 U.S.C. §371 of International Application No. PCT/CN2011/071383 filed on Feb. 28, 2011, entitled TEMPERATURE ADAPTIVE BANDGAP REFERENCE CIRCUIT, which takes its priority from Chinese Patent Application No. 2011100040925.5 filed on Feb. 18, 2011, and all of whose entire disclosures are incorporated by reference herein.

BACKGROUND OF THE INVENTION

Voltage and current references are widely used in integrated circuits. Such references exhibit little dependence on supply and temperature. The objective of reference is to establish dc voltage or current that is independent of the power supply and process and has a well-defined behavior with temperature. Since 1980s bandgap reference was invented, it has been widely used in various analog circuits. However, even if the process works in small variations, traditional bandgap reference also has its limitations, which are mainly due to non-linear relationship between output voltage and temperature. This non-linear relationship of the traditional bandgap reference can be explained in FIG. 1. Although the devices are perfectly matched, the output voltage deviation will still be 35 ppm from −20° C. to 100° C. for first order compensation. Such deviation is undesirable in many applications. The bandgap voltage reference shown in FIG. 1 includes the first bipolar transistor Q1, the second bipolar transistor Q2, the output module consisted of field-effect transistor MN1 (N-type), the adjustment module consisted of operational amplifier OP and the resistor network consisted of resistors R1~R4. One node of the fourth resistor R4 is connected to MN1 as the output port of the output module. The other node of R4 is connected the third resistor R3 and the second resistor R2. The other node of the third resistor R3 is connected with the positive input of operational amplifier OP. The node is connected to ground by the first bipolar transistor Q1. The other node of the second resistor R2 is connected to the negative input of operational amplifier OP, and is then connected to ground by the first resistor R1 and the second bipolar transistor Q2. Q1 and Q2 shown in FIG. 1 are fabricated by typical CMOS process, the emitter area ratio of them are $A_{E1}/A_{E2}$. The operational amplifier OP clamps the voltage on R2 and R3 to be equal. The voltage on R1 can be given as:

$$V_{PTAT}=VV_{BE}=V_{BE2}-V_{BE1}$$

This voltage is directly proportional to absolute temperature:

$$V_{PTAT}=\frac{kT}{q}\ln\left(\frac{A_{E1}}{A_{E2}}\right)$$

(T is absolute temperature, K is the Boltzmann factor, q is electric charge of carrier)

The output voltage $V_{REF}$ can be given as:

$$V_{REF}=V_{BE}+KVV_{BE} \quad (1)$$

Where K is a factor which is used to compensation the first order temperature coefficient of $V_{BE}$. K is determined by the resistor network.

The bandgap voltage references mentioned above are almost the prototype of all the bandgap references. Although it has been designed perfectly match, the output voltage will also have a 35 ppm deviations in −20° C.~100° C. which are caused by the curvature of the temperature characteristic curve for $V_{REF}$. As shown in FIG. 3, when the resistance varies, the output voltage changes with temperature. Such deviation is still undesirable in many applications. Lots of curvature correction techniques have been invented, but most of the techniques are to compensate high order temperature coefficient. The compensation term is difficult to generate in the standard CMOS technology and the high order compensation is sensitive to process.

The temperature deviations of traditional bandgap reference are large and the high order compensation is difficult to implement. This invention's objective is to provide bandgap reference which uses the lower order (first order) compensated bandgap voltage reference to generate reference voltage with much lower temperature coefficient.

BRIEF SUMMARY OF THE INVENTION

The invention is bandgap reference circuit with linearly compensated segments. The bandgap voltage reference includes output module, adjustment module and resistor network. The resistor network is connected with output module. The two branches of the resistor network are connected to ground through the first and the second bipolar transistor, respectively. The adjustment module samples the voltage of the two branches to adjust the output voltage of the output module. The adjustment module includes sample and hold circuit, voltage comparator and control module. The input of the sample and hold (S/H) circuit is connected with the output voltage of the output module. The output of S/H is connected with the input of the voltage comparator. The output of the voltage comparator is connected with control module. The output of the control module is connected with the resistor network. According to the output of the voltage comparator the resistance of the resistor network is changed, and then the output voltage of the output module changes. The maximum voltage will be the output module's output voltage, after finding the resistance of the resistor network when the output voltage gets the maximum value.

Especially, the resistor of resistor network performances low temperature coefficient.

The resistor network includes four resistors: the fourth resistor, the third resistor, the second resistor and the first resistor. One end of the fourth resistor is connected with the output module as output of the module. The other end of it is connected with the third resistor and the second resistor. The other end of the third resistor is connected with one of the input of the adjustment module and is then connected to ground by the first bipolar transistor. The other end of the second resistor is connected with another input of the adjustment module and then connected to ground by the second bipolar transistor.

Especially, the control module changes the resistor network by changes the first resistor and the fourth resistor.

Especially, the adjustment module is an operational amplifier. The output module is NMOS field-effect transistor. The output of the operational amplifier is connected with the gate of the NMOS field-effect transistor. The two inputs of the operational amplifier are the inputs of the adjustment module. The source of the NMOS field-effect transistor is the output of the output module, and the drain of the NMOS field-effect transistor is connected to the power supply.

Furthermore, there is low-pass filter connected to the output of the output module.

Specially, the low-pass filter is composed of resistor and capacitor. One end of the resistor is connected to ground and the other end is the output of the low-pass filter which is connected to ground through the capacitor.

The benefit of this invention is the bandgap voltage reference optimization on system level with high process compatibility. This invention can find the segment with smallest temperature coefficient adaptively. The output voltage is combination of segments with local low temperature coefficient. The invention meets the requirement of fabrication process of nowadays, and the implementation is simple and area efficient.

SUMMARY OF THE INVENTION

This invention provide a detail technical solution of bandgap reference. The invention uses segmental compensation circuit to realize adaptive segmental compensation of bandgap reference with low temperature coefficient. The technical solution includes a basic bandgap voltage reference circuit and an adaptive feedback compensation circuit.

DETAILED DESCRIPTION OF THE INVENTION

Figure 1:
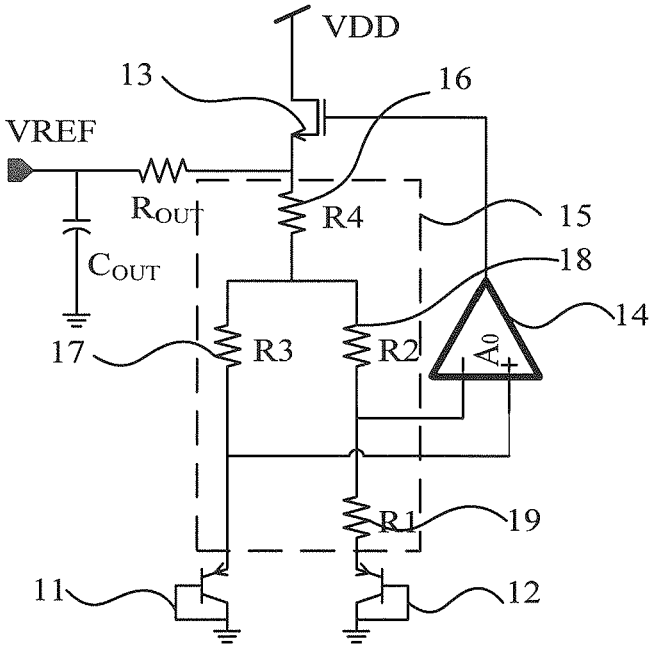
FIG. 1 is the schematic of the traditional bandgap voltage reference.
Figure 2:
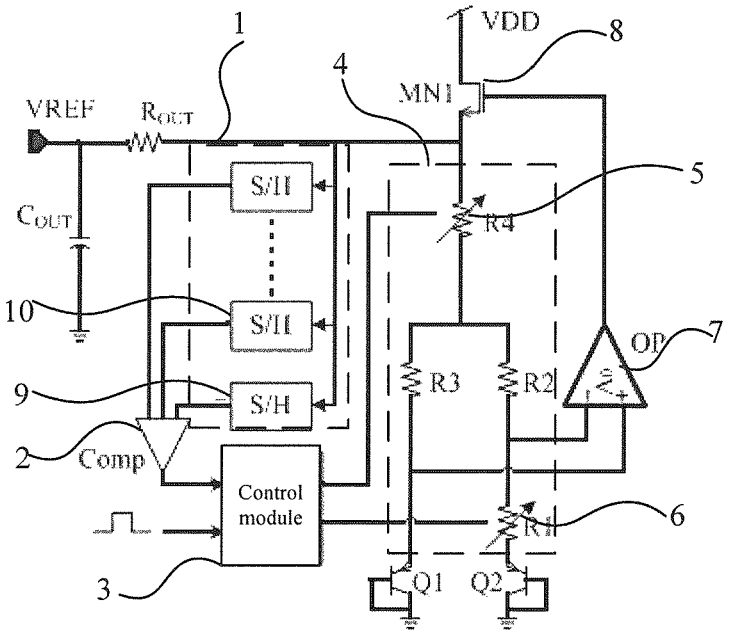
FIG. 2 is the schematic of this invention.

FIG. 2 shows the schematic of the temperature adaptive bandgap reference. It is composed of sample and hold circuit 1, voltage comparator 2 and a control module 3 based on traditional bandgap reference. The traditional bandgap reference is shown in FIG. 1. It includes the first bipolar transistor 11, the second bipolar transistor 12, NMOS field-effect transistor 13, operational amplifier 14 and the resistor network 15. The resistor network is composed of 4 resistors: a fourth resistor 16, a third resistor 17, a second resistor 18 and a first resistor 19. One end of the fourth resistor 16 is connected with the field-effect transistor 13 as the output port of the output module. The other end of resistor 16 is connected to the third resistor 17 and the second resistor 18. The other end of the third resistor 17 is connected with the positive input of operational amplifier 14, which is connected to ground by the first bipolar transistor 11. The other end of the second resistor 18 is connected with the negative input of operational amplifier 14, they are connected to ground by the first resistor 19 and the second parasitic transistor 12.

The sample and hold circuit includes N sample and hold unit (S/H1, S/H2, . . . S/Hn). They can sample and hold N different output voltages. These sample and hold units receive the output voltage of the output module and send to the voltage comparator 2, as shown in FIG. 2. The output of the voltage comparator 2 is connected with the control module 3. The control module 3 is connect with the resistor network 4, changing the resistance of the resistor network 4 by changes the resistance of resistor 5 and 6 according the output of the voltage comparator 2. The resistance alteration of the resistor network 4 also changes the input voltage of the operational amplifier 7. The output of the field effect transistor 8 $V_{REF}$ will be changed at the same time. Then we can find the resistance of the resistor network when the output voltage is maximum at given temperature. The maximum voltage will be the output voltage of the output module.

Assuming the control module 3 generates three pulse signals. Each pulse signal lasts one period cycle. At specific time T, the counter in the control module generates the first pulse series Z1. The resistance of the first resistor 6 and the fourth resistor 5 are dominated by Z1. Thus the resistance of the resistor network is controlled by Z1. It means the K factor is controlled by Z1. We name the output voltage $V_{REF}$ as V1. S/H1 9 samples and holds V1. During the next period cycle, the control module 3 generates the second pulse signal Z2, Z2 controls the equivalent resistance of the resistor network 4. The output at this time is defined as V2. V2 is sampled and held by SH/2 10. These two sampled voltages are compared and then the result returns to the control module. Similarly, the third output voltage V3 is obtained at the third cycle. These three voltages will be compared and find the maximum one. The maximum voltage will be the output voltage $V_{REF}$. The combined curve with the maximum voltage has the best temperature coefficient at given temperature. So the control module 3 will select the pulse signal which makes the resistance of the resistor network 4 corresponding to the maximum output voltage according to the result of the comparator 2 at current temperature and this pulse signal is kept until the counter in the control module 3 is triggered during the next detect cycle.

Figure 3:
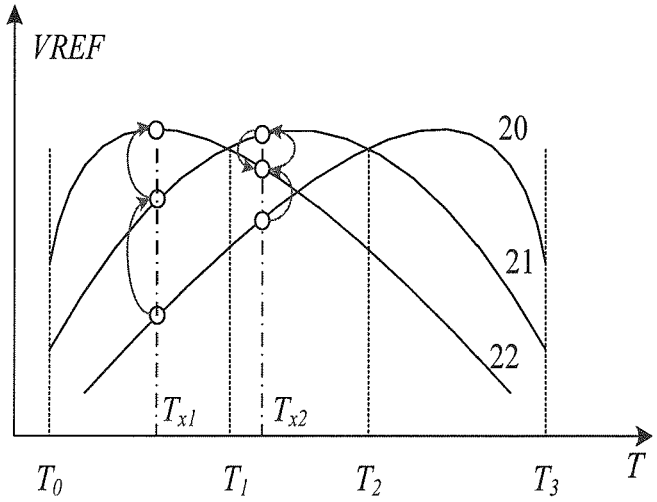
FIG. 3 is a diagram showing the process of temperature adaptive.
Figure 4:
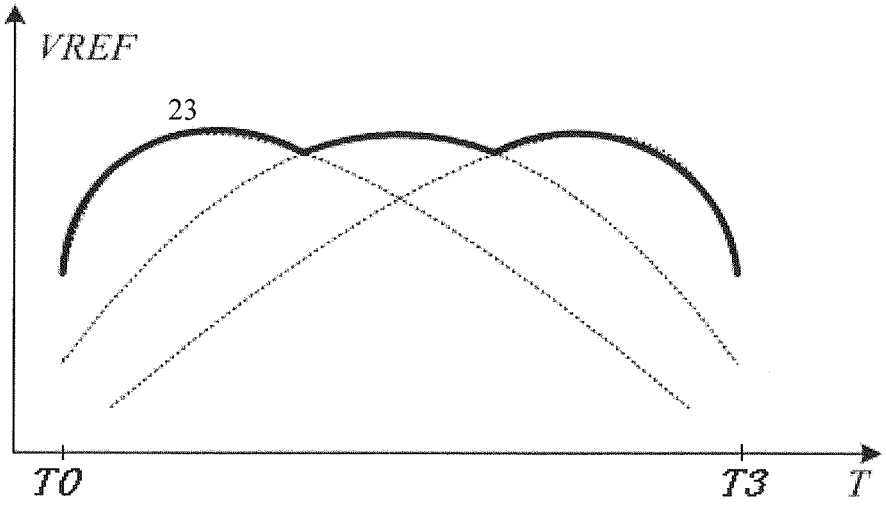
FIG. 4 is the temperature curve of the output voltage.

FIG. 3 shows three different temperature characteristic curves of the output bandgap voltage reference of the field effect transistor 8 corresponding to three different resistance of the resistor network 4, named as 20, 21 and 22. It is shown in FIG. 3 with different values of K. The maximum value of the temperature characteristic curve is at different temperatures. Obviously, curve 21 has the minimum temperature coefficient at the middle temperature region (T1 to T2); curve 22 has the minimum temperature coefficient at the left temperature region (T0 to T1), curve 20 has the minimum temperature coefficient at the right temperature region (T2 to T3). The curve of highest voltage has the best temperature coefficient which has the minimum curvature out of the three curves. FIG. 2 shows us a reasonable way to find the appropriate resistance of the resistor network. The thick solid line 23 in FIG. 4 shows the temperature characteristic curve of the output voltage $V_{REF}$ in the entire temperature range (T1 to T3) after adjusting. As shown in the figure, the temperature characteristic curve of the output voltage has been improved dramatically with the invention.

What is claimed is:

1. A temperature adaptive bandgap reference circuit, comprising a bandgap voltage reference including an output module, an adjustment module and a resistor network, the resistor network connected with the output module, the resistor network having two branches connected to ground by a first bipolar transistor and the second bipolar transistor, respectively, the adjustment module sampling a voltage of the two branches to adjust an output voltage of the output module, the adjustment module including a sample and hold circuit, a voltage comparator and a control module, the sample and hold circuit having an input connected with the output voltage of the output module, the sample and hold circuit having an output connected to an input of the voltage comparator, the voltage comparator having an output connected with an input of the control module the control module having an output connected with the resistor network wherein according to the output of the voltage comparator, the resistance of the resistor network is changed and the output voltage of the output module is changed, and finding the resistance of the resistor network when the output voltage reaches a maximum value results in the output voltage of the output module being a maximum voltage.

2. The temperature adaptive bandgap reference circuit according to claim 1, said temperature adaptive bandgap reference circuit and the resistor network having a low temperature coefficient.

3. The temperature adaptive bandgap reference circuit according to claim 2, the resistor network including a first resistor, a second resistor, a third resistor and a fourth resistor, the fourth resistor having a first end connected with the output module as the output of the output module, the fourth resistor having a second end connected with a first end of the third resistor and a second end of the second resistor, the third resistor having a second end connected with an input of the adjustment module and connected to ground via the first bipolar transistor, and the second resistor having a second end connected with another input of the adjustment module and connected to ground via the second bipolar transistor.

4. The temperature adaptive bandgap reference circuit according to claim 3, the control module changing the resistance of the resistor network by changing the first resistor and the fourth resistor.

5. The temperature adaptive bandgap reference circuit according to claim 3, the control module being an operational amplifier, and the output module being a NMOS field-effect transistor, the output of the operational amplifier being connected with a gate of the NMOS field-effect transistor, the operational amplifier having two inputs being the input of the adjustment module, the NMOS field-effect transistor having a source being the output of the output module, and the NMOS field-effect transistor having a drain connected to the power supply.

6. The temperature adaptive bandgap reference circuit according to claim 1, further comprising a low-pass filter connected with an output port of the output module.

7. The temperature adaptive bandgap reference circuit according to claim 6, the low-pass filter including a resistor and a capacitor, the resistor having a first end connected to ground and a second end being the output of the low-pass filter, the low-pass filter being connected to ground through the capacitor.

8. The temperature adaptive bandgap reference circuit according to claim 1, the resistor network including a first resistor, a second resistor, a third resistor and a fourth resistor, the fourth resistor having a first end connected with the output module as the output of the output module, the fourth resistor having a second end connected with a first end of the third resistor and a second end of the second resistor, the third resistor having a second end connected with an input of the adjustment module and connected to ground via the first bipolar transistor, and the second resistor having a second end connected with another input of the adjustment module and connected to ground via the second bipolar transistor.

9. The temperature adaptive bandgap reference circuit according to claim 8, the control module changing the resistance of the resistor network by changing the first resistor and the fourth resistor.

10. The temperature adaptive bandgap reference circuit according to claim 8, the control module being an operational amplifier, and the output module being a NMOS field-effect transistor, the output of the operational amplifier being connected with a gate of the NMOS field-effect transistor, the operational amplifier having two inputs being the input of the adjustment module, the NMOS field-effect transistor having a source being the output of the output module, and the NMOS field-effect transistor having a drain connected to the power supply.

* * * * *